US007031628B2

(12) United States Patent
Sekovski et al.

(10) Patent No.: US 7,031,628 B2
(45) Date of Patent: Apr. 18, 2006

(54) SYSTEMS AND METHODS FOR SETTING UP GRID VOLTAGES IN A TANDEM PIN CHARGING DEVICE

(75) Inventors: David Sekovski, Rochester, NY (US); Jing Qing Song, Webster, NY (US); John Francis O'Brien, Fairport, NY (US); Stephen Ferris Randall, Rochester, NY (US); Song-Feng Mo, Webster, NY (US)

(73) Assignee: Xerox Corporation, Stamford, CT (US)

( * ) Notice: Subject to any disclaimer, the term of this patent is extended or adjusted under 35 U.S.C. 154(b) by 96 days.

(21) Appl. No.: 10/707,578

(22) Filed: Dec. 22, 2003

(65) Prior Publication Data

US 2005/0135825 A1 Jun. 23, 2005

(51) Int. Cl.
*G03G 15/02* (2006.01)

(52) U.S. Cl. ..... 399/50; 399/171; 399/173

(58) Field of Classification Search ..... 399/50, 399/168, 170, 171, 173; 250/324, 325, 326; 361/225

See application file for complete search history.

(56) References Cited

U.S. PATENT DOCUMENTS

| | | | | |
|---|---|---|---|---|
| 4,725,732 | A | 2/1988 | Lang et al. | |
| 5,257,073 | A * | 10/1993 | Gross et al. | 399/171 |
| 5,466,938 | A * | 11/1995 | Nakayama et al. | 250/326 |
| 5,537,198 | A | 7/1996 | Jackson | |
| 5,572,295 | A * | 11/1996 | Sakagami et al. | 399/50 |
| 5,666,604 | A * | 9/1997 | Nakagami et al. | 399/171 |
| 5,845,179 | A * | 12/1998 | Damji et al. | 399/168 |
| 6,459,873 | B1 | 10/2002 | Song et al. | |
| 6,735,407 | B1 * | 5/2004 | Chavez et al. | 399/170 |

* cited by examiner

*Primary Examiner*—Sandra L. Brase

(57) ABSTRACT

Systems and methods for setting up grid voltage for a tandem pin charging device for charging a photoreceptor in a xerographic printing machine. A charge-generating emitter ratio of a first charging unit is determined and a first grid voltage is set based on the charge-generating emitter ratio of the first charging unit. A charge-generating emitter ratio of a offset voltage is then determined and a second grid voltage is set, based on the determined charge-generating emitter ratio of the offset voltage. A final voltage of a photoreceptor is then compared with a final target voltage.

20 Claims, 6 Drawing Sheets

SYSTEMS AND METHODS FOR SETTING UP GRID VOLTAGES IN A TANDEM PIN CHARGING DEVICE

BACKGROUND OF THE INVENTION

1. Field of the Invention

This invention relates to systems and methods for controlling process parameters for a xerographic printing machine.

2. Description of Related Art

The use of charging devices for photoreceptors in xerographic printing is well known in the art. Typically, such charging devices may be one or more of a corotron, a dicorotron, a pin corotron, a scorotron, a discorotron, and/or a pin scorotron. Such charging devices may include a chamber arranged with one or more charge-generating emitters such as, for example, a wire, a dielectric wire, or a pin array. Some charging devices may also include a control grid to regulate and control the charge provided to the photosensitive member. In this way, the photosensitive member may receive a uniform charge at a desired potential.

As known in the art, a key characteristic of a charging device is the di/dV ratio or charge generating emitter ratio of the charge-generating emitter of the charging device. The di/dV ratio is also known as the "slope" of the emitter, and is generally expressed in units of Amperes per volt-meter. Typically, charging devices having a high slope have high overshoot output voltage, i.e., generate a voltage on the photoreceptor that is above the grid voltage, and have poor charging uniformity. In a pin scorotron, the ions generated from the coronode are accelerated by the field force past the screen or grid to reach the photoreceptor surface, thus increasing the surface potential beyond the grid voltage.

When the surface potential reaches the same voltage as the voltage on the screen or grid, there is no electrostatic field between the screen and the photoreceptor. However, since the ions have high residual momentum as the ions approach the grid from the coronode side, the ions will continue to penetrate the grid and build up a space charge. This extra space charge drives some ions to the photoreceptor surface, increasing the surface potential further, until the repulsion field force is large enough to prevent further ion transport. The overshoot voltage may be defined as the extra difference in voltage, above the grid voltage, that the photoreceptor potential needs to reach to prevent further ion transport.

As the current flowing from each pin differs from pin to pin, the time to reach the final overshoot voltage also varies from pin to pin. The time required for charging a surface under the charging device is determined by the width of the charging device and the process speed of the photoreceptor surface being charged past the charging device. This time may be limited by practical considerations, and not all pins may reach the ultimate overshoot voltage. All of this tends to limit the voltage uniformity of practical pin devices.

However, uniform photoreceptor charging is required to achieve high-quality xerographic results. As such, various ways to achieve desired levels of uniform charging are known. For example, U.S. Pat. No. 6,459,873 to Song et al. discloses a DC pin scorotron charging apparatus for charging a photoreceptor to a desired voltage. In this charging device, a first DC pin scorotron charging device initially charges the photoreceptor to an intermediate overshoot voltage. A second DC pin scorotron charging device thereafter uniformly charges the photoreceptor to the final voltage. The first charging device provides a generally high percent open control grid area, a generally high emitter slope, and a generally high emitter pin current. The second charging device provides a generally low percent open control grid area, a generally low emitter slope, and a generally low emitter pin current.

The goal of the first charging device is to provide the majority of the charging ions to the photoreceptor. The first charging device is designed as a high slope device with high screen open area, high coronode voltage (current) and close pin-to-screen spacing. This design tends to result in high overshoot voltage. Therefore, the screen voltage is purposely set lower than the required charging voltage. An offset voltage is defined as the grid voltage difference between the first charging device and the second charging device. The offset voltage is important and should be greater than the overshoot voltage of the first charging device.

The second charging device provides "uniform" charge leveling with little charge-up needed to bring the entire voltage of the surface being charged to the desired photoreceptor potential as uniformly as possible. Because the first charging device has provided most of the charging ions to the photoreceptor, the first charging device significantly reduces the required charging capability of the second charging device. Thus, the second charging device may be a low slope, low overshoot device. This may be accomplished by decreasing the screen open area, for example, to less than 50–60 percent, lowering the coronode voltage (current) and/or increasing the pin-grid spacing in the second charging device relative to the first charging device. Because each of these changes may improve the charging uniformity of the second charging device relative to the first charging device, the final photoreceptor potential should be close to the applied screen voltage on the second charging device with little overshoot.

SUMMARY OF THE INVENTION

In an image forming device that uses multiple charging devices to charge the photoreceptor to a final voltage, it is desirable that the offset voltage, that is, the voltage difference between the grid voltages of the different charging devices, be set appropriately. If the offset voltage is too small, the overshoot voltage of the first device results in the photoreceptor charging potential being higher than the grid voltage of the second device. In this case, the second device is effectively shut off. Consequently, the charging uniformity on the photoreceptor will be poor, because the system fails to benefit from the charge uniformity the second charging device is able to create. If the offset voltage is too large, a high charge-up requirement is imposed on the second device. Because the second charging device is a lower slope device, it may be not be capable of achieving the ultimate desired charge potential on the photoreceptor from all of the pin emitters, thus reducing the charging uniformity of the charge on the photoreceptor.

Static set points generally cannot be used to set the grid voltage of the first and second charging devices because such static set points cannot meet the performance requirements for charging photoreceptors. Variations in charging performance may occur, for example, because of deviations in mechanical tolerances, variations in environmental conditions, such as, for example, temperature, pressure, and/or humidity, and the like. In addition, mechanical tolerance deviations, as well as environmental variations, vary over time. Thus, ultimate copy quality is affected over time, as a result of mechanical and environmental variations. This results in increased service calls related to copy quality problems. As such, there is a need for a low cost solution for controlling the offset voltage.

This invention provides systems and methods for automatically setting up the grid voltages for a dual charger charging system.

This invention separately provides methods that automatically compensate for mechanical and environmental effects to ensure the appropriate set points for a dual-charger charging system.

This invention separately provides systems and methods for substantially improving charging uniformity by exploiting the maximum benefits of the second charging unit of a dual-charger charging system.

This invention separately provides systems and methods for enabling the use of low cost devices such as pin scorotrons to replace higher cost devices to enhance copy quality and reduce service calls related to copy quality problems.

In various exemplary embodiments according to this invention, the final ideal photoreceptor potential and the preferred grid voltage of the second unit are set to the same voltage. The interim ideal photoreceptor potential after passing the first charging device, may be, for example, 50–70 volts lower than the final ideal photoreceptor voltage. Due to the high overshoot capability of the first charging unit, the grid voltage of the first charging unit should be set even lower.

In various exemplary embodiments, systems and methods according to this invention may be used to compensate for variations in charging conditions due to mechanical tolerances and/or environmental conditions. For example, during machine warm-up, the first charging unit of the dual pin scorotron system is enabled, while the second charging unit is disabled. Then, the grid voltage of the first charging unit is started at a low setting and is increased in desired increments. An electrostatic voltage meter (ESV) may be used to measure the interim photoreceptor potential after the photoreceptor is charged by the first charging device. The measured interim photoreceptor potential from the ESV is used in a closed-loop feed-back system to adjust the first voltage of the first charging unit. In various exemplary embodiments, these closed loop feed-back adjustment systems and methods enable the interim photoreceptor potential, after passing the first charging device, to be about 40 volts less than the second grid voltage and final photoreceptor potential. Thus, the interim photoreceptor potential, after passing the first charging device, is at a desirable point for the second charging device to add additional charge to the photoreceptor and to reduce voltage nonuniformity.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the invention will be described with reference to the accompanying drawings, in which like elements are labeled with like numbers, and in which.

DETAILED DESCRIPTION OF EXEMPLARY EMBODIMENTS

Figure 1:
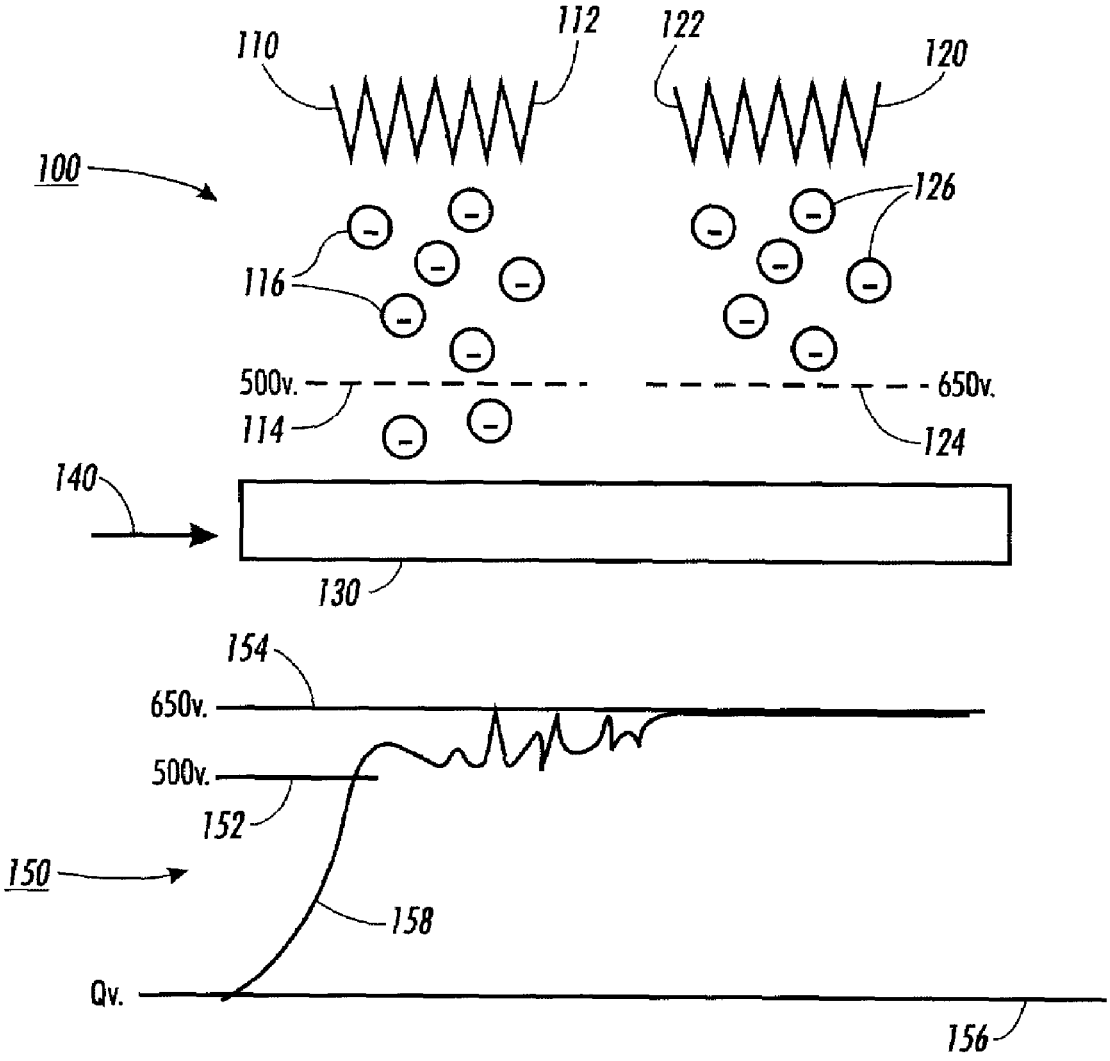
FIG. 1 shows one exemplary embodiment of a dual pin scorotron system usable with this invention and a corresponding graph illustrating the resulting photoreceptor potential.

FIG. 1 illustrates one exemplary embodiment of a dual pin scorotron system 100 and a graph 150 that illustrates the measured voltage on a photoreceptor 130 as the photoreceptor 130 passes a first charging unit 110 and a second charging unit 120 of the dual pin scorotron system 100. In a typical dual pin scorotron system 100, ions 116 generated from a pin scorotron 112 of the first charging unit 110 are accelerated by a field force past a first grid 114 to reach the photoreceptor 130, thus increasing the surface potential of the photoreceptor 130. When the surface potential $V_{1C}$ of the photoreceptor 130 reaches the same voltage $V_{grid1}$ as the voltage on the first grid 114, there is no electrostatic field between the first grid 114 and the photoreceptor 130. However, since the ions 116 have high residual momentum as they approach the first grid 114 from the first charging unit 110, the ions 116 will continue to penetrate the first grid 114 and build up a space charge. This extra space charge drives some ions 116 to the surface of the photoreceptor 130. This further increases the surface potential $V_{1C}$ of the photoreceptor 130 until the repulsion field force is large enough to prevent further transport of the ions 116 through the first grid 114. As stated earlier, the overshoot voltage $V_{1O}$ is defined as the extra difference in voltage that the surface potential $V_{1C}$ of the photoreceptor 130 can reach above the voltage $V_{grid1}$ of the first grid 114.

The first charging unit 110 provides a majority of ions 116 to the photoreceptor 130 and is typically a high slope device with a high screen open area, higher voltage and close pin-to-grid spacing. As such, the first charging unit 110 tends to cause high overshoot voltage. Thus, the grid voltage $V_{grid1}$ of the first grid 114 is purposely set lower than the required charging voltage $V_{1t}$ for the first charging unit 110. As stated earlier, the offset voltage $V_O$ is defined as the difference in grid voltage between the first charging unit 110 and the second charging unit 120.

A curve 158 of the graph 150 illustrates the change in voltage as the photoreceptor 130 passes both the first charging unit 110 and the second charging unit 120. A graph line 156 represents the target voltage of the photoreceptor 130 before passing either of the first charging unit 110 and the second charging unit 120. As illustrated, a graph line 152 represents the target surface potential $V_{1t}$ of the photoreceptor 130 after passing the first charging unit 110. This first or interim target surface potential $V_{1t}$ is, for example, 500 volts. As illustrated by the curve 158, the voltage $V_C$ of the photoreceptor 130 is not uniform, and is, in fact highly varied, after passing the first charging unit 110. However, the voltage $V_C$ becomes quite uniform after the photoreceptor 130 passes the second charging unit 120. A graph line 154 represents the final target voltage $V_{Ft}$ after the photoreceptor 130 passes the second charging unit 120. This final target voltage $V_{Ft}$ is, for example, 650 volts.

The second charging unit 120 may be a low slope, low overshoot device having a decreased screen open area with lowered voltage and increased pin grid spacing relative to the first charging unit 110. Thus, the second charging device 120 has an improved charging uniformity relative to the first charging unit 110. In this embodiment, the final photoreceptor potential $V_{2C}$ may be close to the applied voltage $V_{grid2}$ on a second grid 124 of the second charge device with very little overshoot. Ions 126 may be generated from a pin scorotron 122.

In one exemplary embodiment, the first charging unit 110 may have a large grid open area (70 percent) and a high pin current (9.9 uA/pin). The first charging unit 110 may have a slope of 1.8 uA/(m-V) or more. The overshoot voltage for such a first charging unit 110 may be typically about 100 to 170 volts. The second charging unit 120 may have a small grid open area (50 percent) with a low pin current (7.5 uA/pin). The final target charging potential $V_{Ft}$ of the photoreceptor may be, for example, 650 volts. Because the overshoot $V_{1O}$ of the first charging unit 110 may be about 100 to 120 volts, the voltage $V_{grid1}$ of the first grid 114 may be set at about 500 volts. Thus, the photoreceptor potential after passing the first charging unit 110, i.e. the voltage $V_{1C}$ on the photoreceptor, may be about 600 to 620 volts.

As stated previously, various factors, such as coronode surface conditions and differences in photoreceptor initial voltage across the surface at the entrance to the device, may affect performance and cause poor charging uniformity after passing the first charging unit 110. Because the first charging unit 110 delivers the majority of charging current and brings the potential close to the desired voltage $V_{Ft}$ (650 volts), the required charging range for the second device need only be, for example, about 100 volts to 30 volts. Thus, the second charging unit 120 may be a low slope and low overshoot device. With low overshoot, the photoreceptor potential $V_{2C}$ may stay close to the final target voltage $V_{Ft}$ of 650 volts. The actual final potential $V_{2C}$ depends on the voltage $V_{grid2}$ of the second grid 124 and the photoreceptor potential $V_{1C}$ after passing the first charging unit 110 and may be insensitive to other factors. The required minimum current per pin scorotron 122 for the second charging unit 120 will depend on the process speed of the photoreceptor 130.

With the dual pin scorotron system 100 of this embodiment, traditional low-cost pin scorotrons may be used as the first and second charging devices 110 and 120. As a result, the dual pin scorotron system 100 may be used to achieve a much higher charging uniformity than a traditional single charging unit device. As such, when using a dual-charger charging system according to this invention, the difference between the photoreceptor initial voltage and the intercept voltage of the second charging unit is small. Thus, excellent uniformity can be achieved even though the slope of the second charging unit 120 is relatively low.

Figure 2:
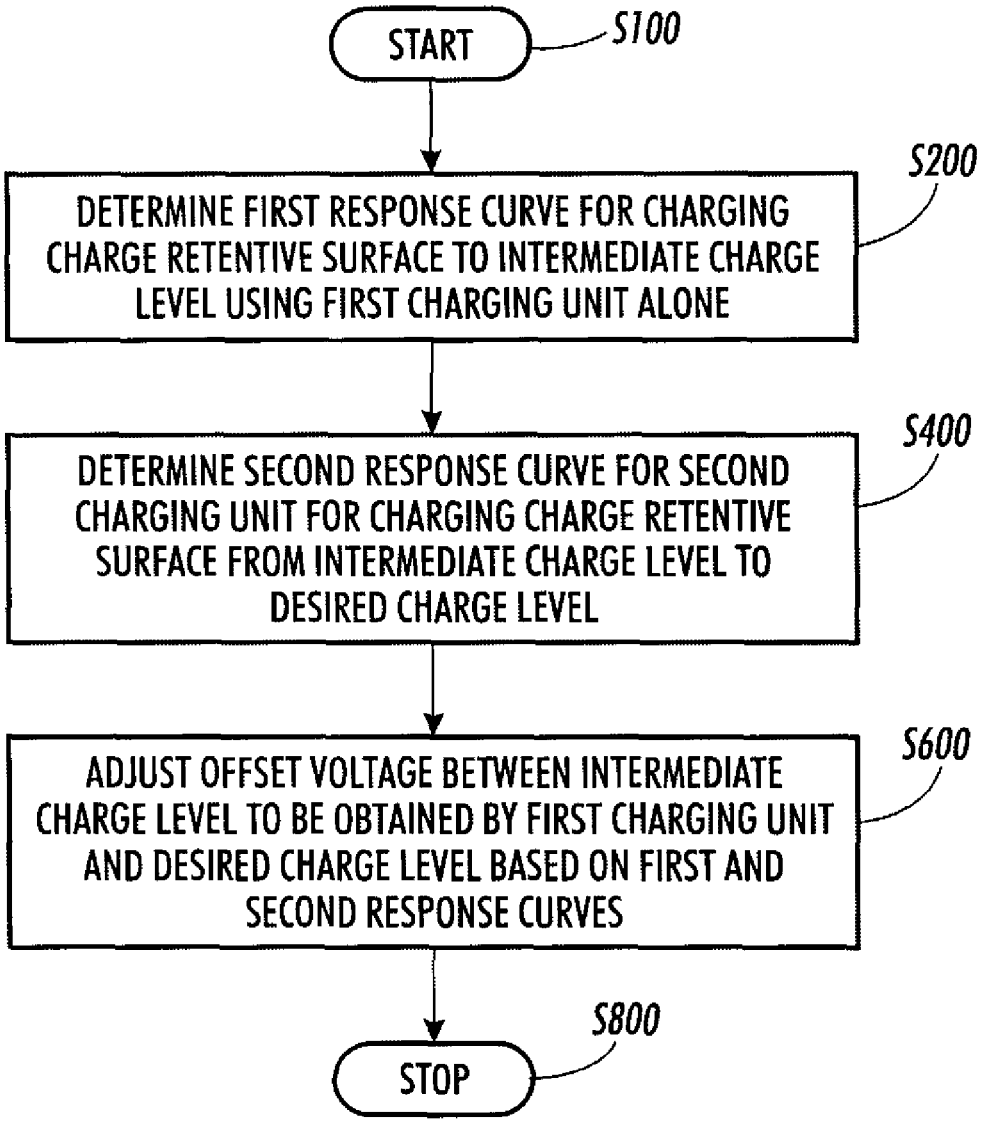
FIG. 2 is a flowchart outlining one exemplary embodiment of a method for automatically setting up the grid voltages of a dual-charger charging system.

FIG. 2 illustrates an exemplary embodiment of a method for automatically setting up the grid voltages $V_{grid1}$ and $V_{grid2}$ of a dual pin scorotron system according to this invention. As shown in FIG. 2, operation of the method begins in step S100, and proceeds to step S200, where the slope of $V_{grid1}$ to the obtained charge $V_{1C}$ on the charge retentive surface due to the first grid charging device is determined. Then, in step S400, the desired target offset voltage $\Delta V_{grid}$ between the target voltage $V_{1t}$ on the grid of the first charging unit and the combined target voltage $V_{Ft}$ of the charge retentive surface is determined based on the slope of $V_{grid2}$ to the charge obtained on the charge retentive surface due to the second charging device. Next, in step S600, the final voltage $V_{2C}$ (or $V_F$) is adjusted, if necessary to come within the desired tolerance of the target voltage $V_{Ft}$. However, it should be appreciate that it may not be necessary to set or adjust the final voltage $V_{2C}$ in the event that the final voltage $V_{2C}$ is already within a desired tolerance of the target voltage $V_{Ft}$. Operation then continues to step S800 where operation of the method ends.

Figure 3:
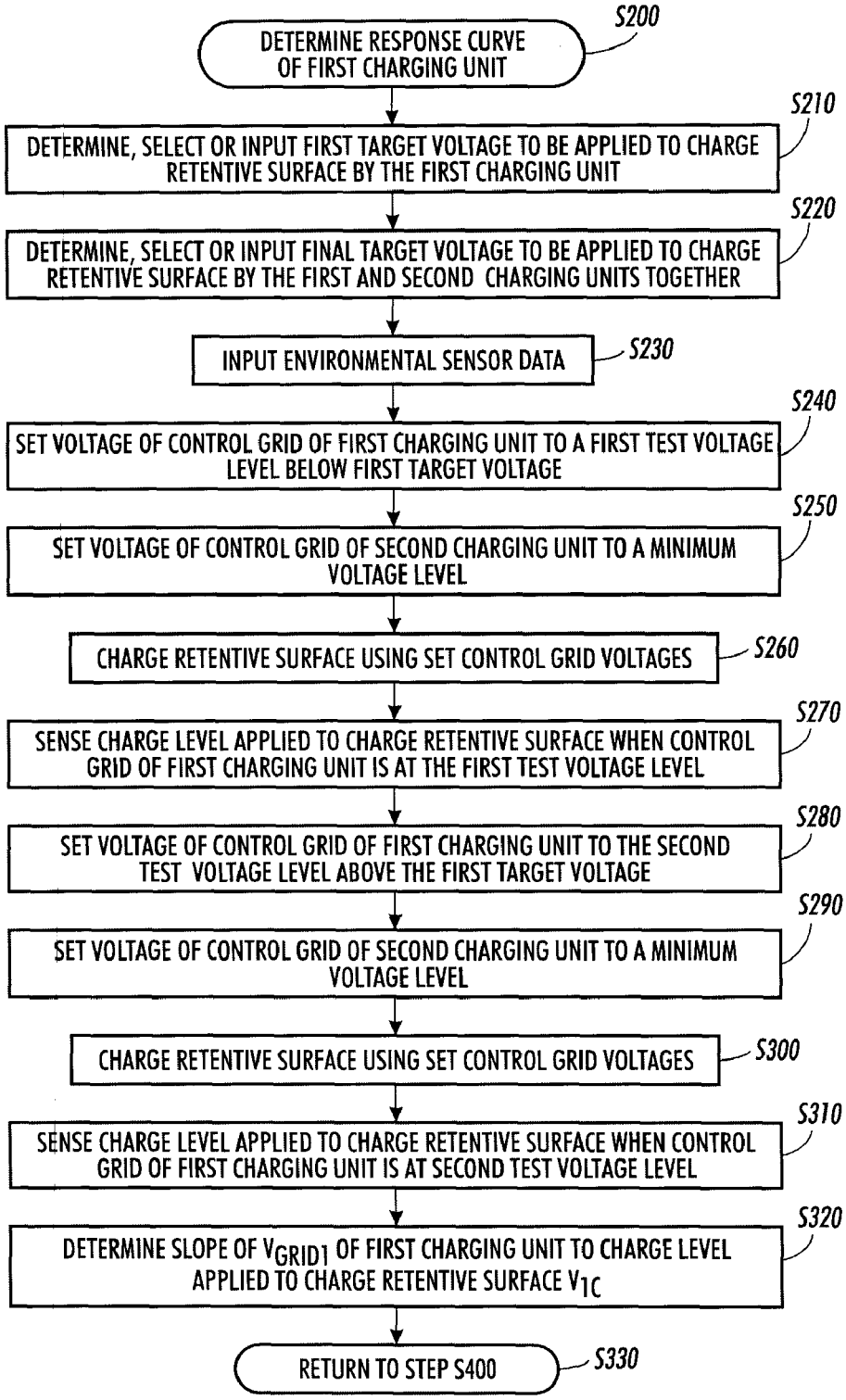
FIG. 3 is a flowchart outlining in greater detail one exemplary embodiment of the method for determining the slope of the first grid of FIG. 2.

FIG. 3 is a flowchart outlining in greater detail one exemplary embodiment of the method for determining the slope of $V_{grid1}$ to $V_{1C}$ for the first charging grid of step S200 according to this invention. As shown in FIG. 3, operation begins in step S200, and proceeds to step S210, where the target voltage $V_{1t}$ to be imparted on the charge retentive surface by the first grid is determined, selected or input. Then, in step S220, the combined target voltage $V_{Ft}$ to be imparted to the charge retentive surface by the first charging device and second charging device together is determined. In various exemplary embodiments, the target voltage $V_{1t}$ on the charge retentive surface may be 500 volts, while the target voltage $V_{2t}$ on the charge retentive surface may be 650 volts, i.e. that the first and second charginge devices together impart a total charge $V_{2C}$ of 650 volts, on the charge retentive surface. Operation then continues to step S230.

In step S230, environmental sensor data is input or read. In various exemplary embodiments, the input or read environmental data is stored in memory. In various exemplary embodiments, memory comprises a non-volatile memory. However, it should be appreciated that data may be stored in any type of known or later-developed memory device. This environmental data may include such information such as, for example, temperature and/or humidity. Next, in step S240, the first grid is set to a first test voltage $V_{grid1a}$. In various exemplary embodiments, this first test voltage level is 100 volts below the target voltage $V_{1t}$ of the first grid. Then, in step S250, the second grid voltage is set to a minimum value such as 0 volts. Operation then continues to step S260.

In step S260, the selected first test voltage $V_{grid1a}$ is applied to first grid as charges are applied to the charge retentive surface by the first charging device. Then, in step S270, the charge imparted to the charge retentive surface $V_{1Ca}$ with the first grid voltage set to the first test voltage $V_{grid1a}$ is read and stored in memory. In various exemplary embodiments, the charge is read using an electronic voltage meter or electrostatic voltage meter (ESV). Next, in step S280, the first grid voltage is set to a second test voltage $V_{grid1b}$. In various exemplary embodiments, this second test voltage $V_{grid1b}$ is 100 volts above the target voltage $V_{1t}$ of the first grid. Operation then continues to step S290.

In step S290, the grid voltage $V_{grid2}$ of the second charging unit is again set to a minimum value, such as 0 volts. Next, in step S300, the selected second test grid voltage $V_{grid1b}$ is applied to the first grid as the grid charges are applied to the charge retentive surface by the first charging device. Then, in step S310, the charge imparted to the charge retentive surface $V_{1Cb}$, with the voltage on the first grid set to the second test voltage $V_{grid1b}$ is read and stored in memory. Operation then continues to step S320.

In step S320, the slope of $V_{grid1}$ to $V_{1C}$ is determined using the stored charge values $V_{1Ca}$ and $V_{1Cb}$ obtained by applying the first and second test voltages $V_{grid1a}$ and $V_{grid1b}$ to the first grid. As described earlier, the slope of $V_{grid1}$ to $V_{1C}$ is expressed in units of Amperes per volt-meter (A/v·m). Based on the response curve for the first charging grid, the voltage level $V_{grid1}$ on the control grid of the first charging unit that will charge the charge retentive surface to the desired target potential voltage $V_{1t}$ can be determined. Operation then continues to step S330, where operation of the method ends.

Figure 4:
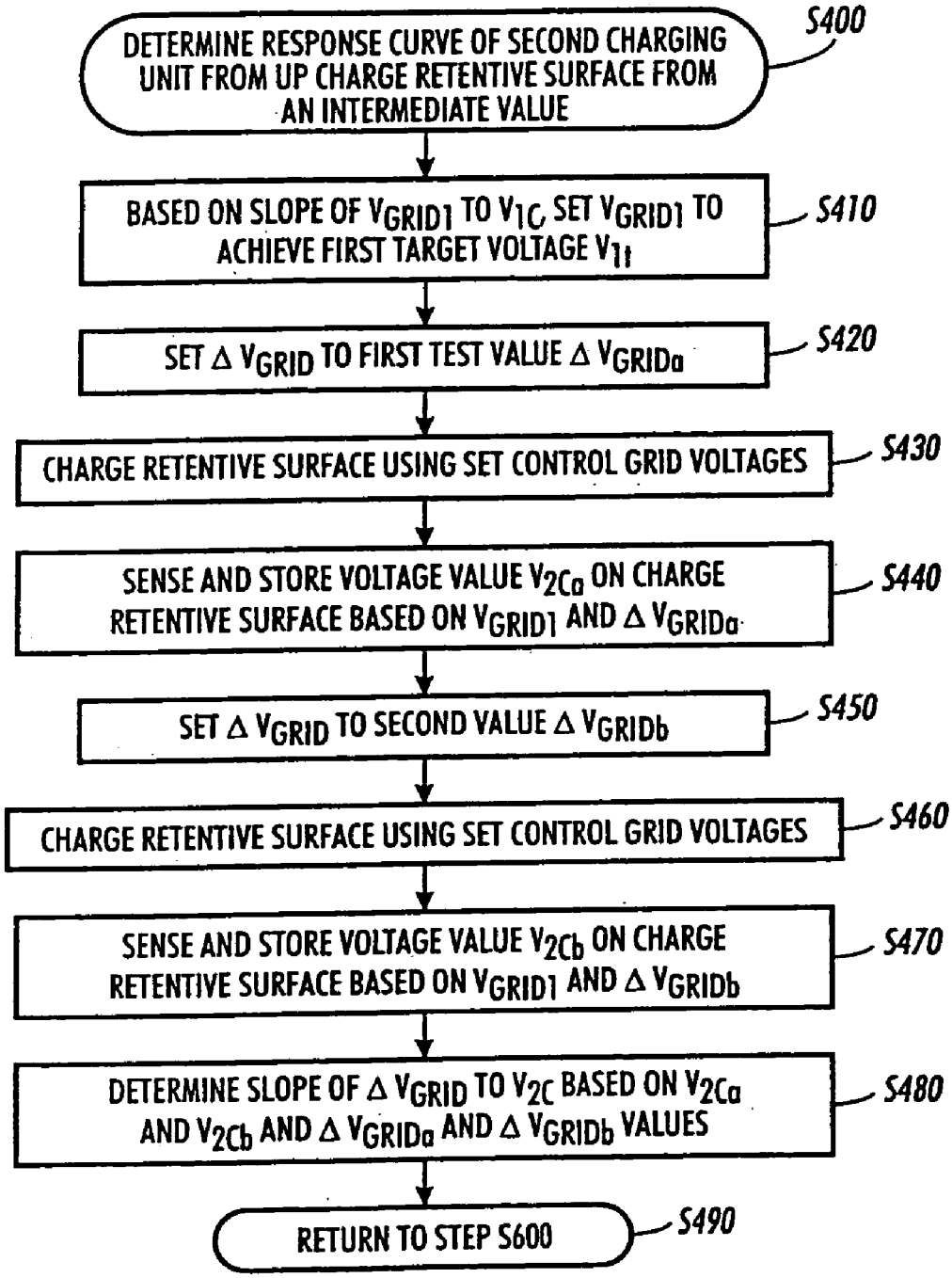
FIG. 4 is a flowchart outlining in greater detail one exemplary embodiment of the method for determining the offset voltage slope of FIG. 2.

FIG. 4 is a flowchart outlining in greater detail one exemplary embodiment of the method for determining the response curve of the second charging grid according to this invention. As shown in FIG. 4, operation of the method begins in step S400 and proceeds to step S410, where, based on the slope of $V_{grid1}$ to $V_{1C}$, the grid voltage on the control grid of the first charging unit is set to a voltage level that will achieve a charge of $V_{1t}$ on the charge retentive surface. Then, in step S420, the offset voltage $\Delta V_{grid}$ is set to a first test voltage $\Delta V_{grida}$. In various exemplary embodiments, the first offset test voltage $\Delta V_{grida}$ is 100 volts "more" than the intermediate target voltage $V_{1t}$. Typically, the charge retentive surface is regularly charged. In this case $\Delta V_{grida}$ is −100V (i.e., 100 volts below $V_{grid1}$). Next, in step S430, the charge retentive surface is charged with the $\Delta V_{grida}$. Then, in step S440, the charge level imparted to the charge retentive surface $V_{2Ca}$ is sensed and stored in memory. Operation then continues to step S450.

In step S450, the offset voltage $\Delta V_{grid}$ is set to a second test voltage $\Delta V_{gridb}$. In various exemplary embodiments, the second test voltage $\Delta V_{gridb}$ is 200 volts "more" than the intermediate target voltage $V_{1t}$. Thus, when the charge retentive surface is negatively charged, ΔVgridb is −200V. Then, in step S460, the charge retentive surface is charged with the first charging grid set to achieve the intermediate target voltage of $V_{1t}$ and the second charging grid is set to achieve an offset voltage $\Delta V_{grid}$ of $\Delta V_{gridb}$. Next, in step S470, the charge imparted to the charge retentive surface $V_{2Cb}$ is sensed and stored in memory. Operation then proceeds to step S480.

In step S480, based on the stored charge levels $V_{2Ca}$ and $V_{2Cb}$ corresponding to $\Delta V_{grida}$ and $\Delta V_{gridb}$, the slope of the offset voltage $\Delta V_{grid}$ to $V_{2C}$ is determined. Operation then continues to step S490, where operation of the method returns to step S600.

Figure 5:
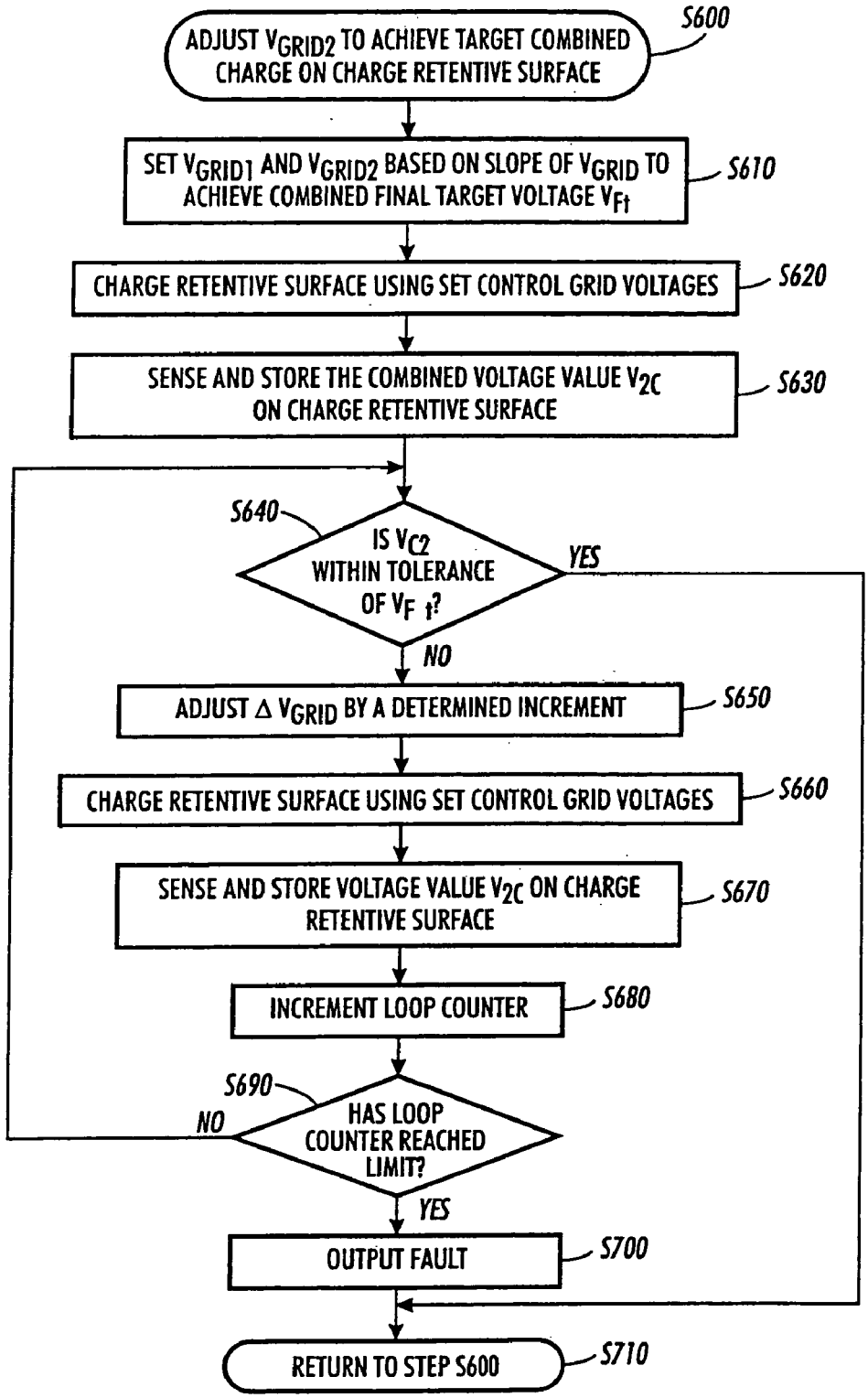
FIG. 5 is a flowchart outlining in greater detail one exemplary embodiment of the method for setting up the voltages on the grids of the dual-charger charging system of FIG. 2.

FIG. 5 is a flowchart outlining in greater detail one exemplary embodiment of the method for determining whether the final photoreceptor voltage $V_{2C}$ is within an acceptable range or tolerance of the target final voltage $V_{Ft}$ of FIG. 2 according to this invention. Operation of the method begins in step S600, and proceeds to step S610, where the voltages $V_{grid1}$ and $V_{grid2}$ on the control grid of the first and second charging devices are set based on the determined slopes for $V_{grid1}$ and $\Delta V_{grid}$, to the achieve the target voltage $V_{Ft}$. Then, in step S620, the charge retentive surface is charged using the first and second charging devices having the control grids set based on $V_{grid1}$ and $\Delta V_{grid}$. Next, in step S630, the actual final voltage $V_{Fa}$ on the charge retentive surface, caused by first and second control grids being set as described is read and stored. Operation then continues to step S640.

In step S640, a determination is made whether the actual final voltage $V_{Fa}$ is within a predetermined tolerance of the target voltage $V_{Ft}$. In various exemplary embodiments, the tolerance for the actual final voltage $V_{Fa}$ can be ±10 volts of the target voltage $V_{Ft}$. If, in step S640, a determination is made that the final actual voltage $V_{Fa}$ is within an acceptable tolerance of the target voltage $V_{Ft}$, operation jumps to step S710. Otherwise, processing proceeds to step S650.

In step S650, the offset voltage $\Delta V_{grid}$ is adjusted by altering the offset voltage $\Delta V_{grid}$ by a determined increment. For example, if the actual voltage $V_{Fa}$ is too high, the offset voltage $\Delta V_{grid}$ is adjusted up by the determined increment. If the actual voltage $V_{Fa}$ is too low, the offset voltage $\Delta V_{grid}$ is adjusted down by the determined increment. It should be appreciated that the determined increment can be predetermined or can be dynamically determined or determined on the fly. For example, the determined increment can be determined based on the difference between the actual and target final voltages $V_{Fa}$ and $V_{Ft}$. In various exemplary embodiments, a reasonable predetermined increment is 5 volts. Next in step S660, the charge retentive surface is charged using the first and second charging devices having the control grids set based on $V_{grid1}$ and $\Delta V_{grid}$. Operation then continues to step S670.

In step S670, the voltage value $V_{Fa}$ imparted to the charge retentive surface based on the new value for $\Delta V_{grid}$ is again sensed and stored. Then, in step S680 a loop counter, representing the number of adjustments that have been made to the offset voltage $\Delta V_{grid}$ is incremented. Then, in step S690, a determination is made whether the value of the loop counter is equal to the maximum allowable number of iterations. If the maximum allowable number adjustments has been made, operation proceeds to step S700. Otherwise, operation returns to step S640. In step S700, a fault indication is output. Operation then continues to step S710, where operation of the method returns to step S800. Thus, once either a fault indication has been output or the measured voltage on the charge retentive surface $V_{Fa}$ is determined to be within the acceptable tolerance of the target voltage $V_{Ft}$, operation of the method returns to step S800.

Figure 6:
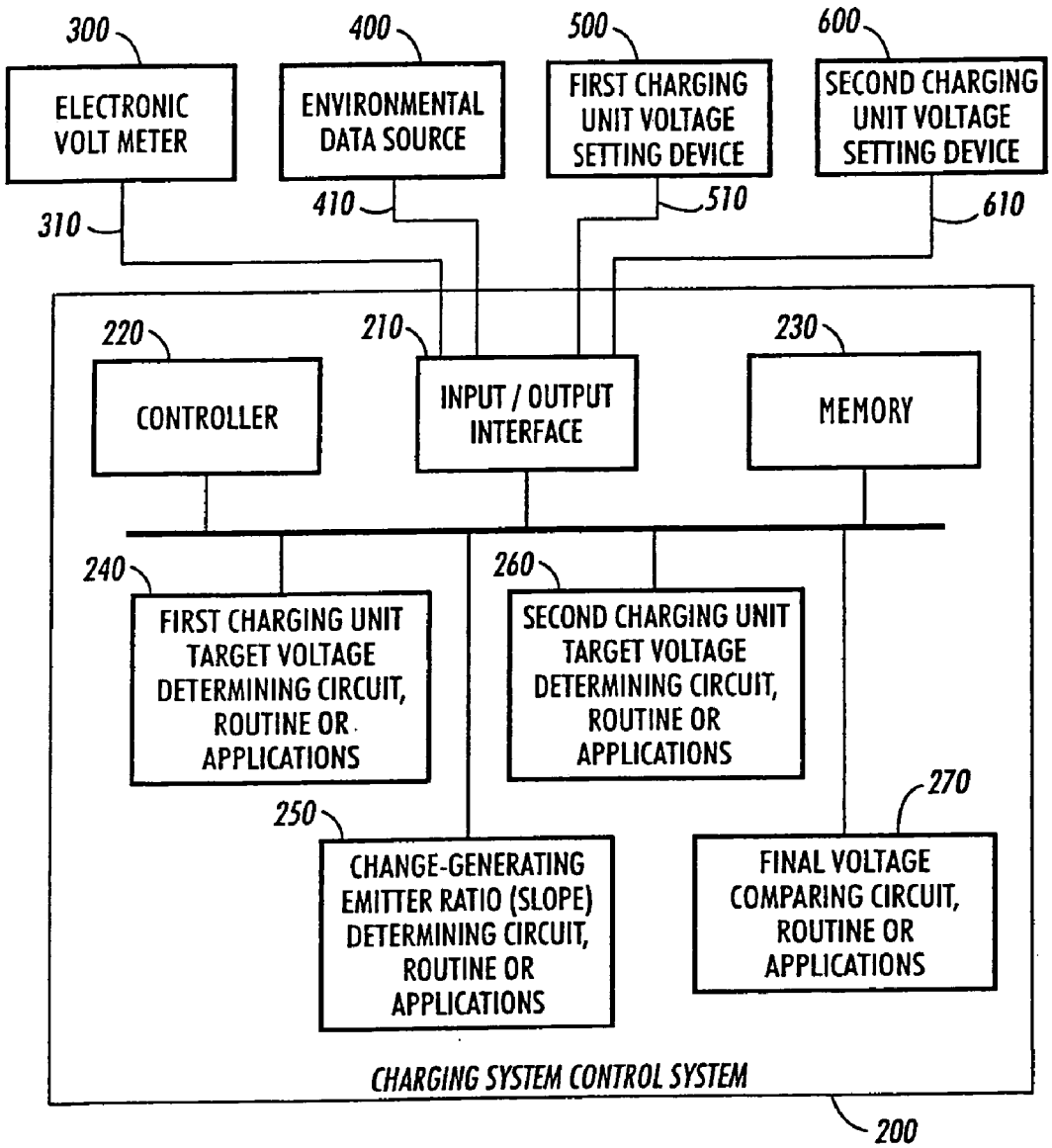
FIG. 6 is a block diagram outlining one exemplary embodiment of a charging system control system usable to determine charging grid voltages for a multiple charging device charging system.

FIG. 6 is a block diagram outlining one exemplary embodiment of a charging system control system 200 according to this invention. As shown in FIG. 6, the charging system control system 200 has an input/output interface 210 that is linked to an electronic volt meter 300 (or any other appropriate charging sensing device) by a link 310. The input/output interface 210 is also linked to an environmental data source 400 by a link 410, a first charging unit voltage setting device 500 by a link 510, and a second charging unit setting device 600 by a link 610. The charging system control system 200 also includes a controller 220, a memory 230, a first charging unit target voltage determining circuit, routine or application 240, a second charging unit target voltage determining circuit, routine or application 260, a slope determining circuit, routine or application 250, and a final voltage comparing circuit, routine or application 270.

Each of the links 310–610 can be any known or later developed connection system or structure usable to connect the respected devices to the charging system control system 200. It should also be understood that the links 310–610 do not need to be of the same type.

The memory 230 can be implemented using any appropriate combination of alterable volatile or non-volatile memory, or non-alterable or fixed memory. The alterable memory whether volatile or non-volatile can be implemented using any one or more of static or dynamic RAM, a floppy disk and disk drive, a writable or rewritable optical disk and disk drive, a hard drive, flash memory or the like. Similarly, the non-alterable or fixed memory can be implemented using any one or more of ROM, PROM, EPROM, EEPROM, and gaps in an optical ROM disk, such as a CD ROM or DVD ROM disk and disk drive, or the like.

In one exemplary embodiment of the operation of the charging system control system 200 according to this invention, environmental data is read by the environmental data source 400. The read environmental data is forwarded from the environmental data source 400 over the link 410 to the charging system control system 200. The received environmental data is output through the input/output interface 210 and stored into the memory 230. A first charging unit target voltage is determined by the first charging unit target voltage determining circuit, routine or application 240. Next, the second charging unit target voltage is determined by the second charging unit target voltage determining circuit, routine or application 260. The first charging unit voltage setting device 500, based on control signals from the controller 220, sets the control grid voltage for the first charging device to a first value below the determined first charging unit target voltage.

The first charging device is then used to charge a photoreceptor or other charge-retentive surface. The charge applied to the charge-retentive surface by the first charging device is then read by the electrostatic volt meter 300. The read charge is input by the electronic volt meter 300 over the link 310 to the charging system control system 200. The received data is input through the input/output interface 210 and stored in the memory 230.

The first charging unit voltage setting device 500, based on control signals from the controller 220, sets the control grid voltage for the first charging device to a second value above the determined first charging unit target voltage. The first charging device is then again used to charge a photoreceptor or other charge-retentive surface. The charge applied to the charge-retentive surface by the first charging device is then again read by the electronic volt meter 300. The read charge is input by the electronic volt meter 300 over the link 310 to the charging system control system 200. The received data is input through the input/output interface 210 and stored in the memory 230. The charge-generating emitter ratio (slope) of the first charging unit is then determined by the charge-generating emitter ratio determining circuit, routine or application based on the first and second voltages the control grid of the first charging device was set to and the high and low voltages read by the volt meter 300 and stored in memory 230.

Based on the charge-generating emitter ratio of the first grid as determined by the charge-generating emitter ratio determining circuit, routine or application 250, the first charging unit target voltage determining circuit, routine or application 240 determines a setback target voltage and stores this data in the memory 230. The first grid voltage is then set to the setback target voltage by the first charging unit voltage setting device 500 based on control signals from the controller 220. The second charging unit voltage setting device 600 then, based on control signals from the controller 220, sets the control grid of the second charging device to 100 volts below the final target voltage. The first and second charging devices are then used to charge the charge retentive surface. The electronic volt meter 300 then reads the voltage on the charge retentive surface and stores the voltage in the memory 230. The second charging unit voltage setting device 600 then sets, based on control signals from the controller 220, the control grid of the second charging device to 100 volts above the final target voltage. The first and second charging devices are then used to charge the charge retentive surface. The electrostatic volt meter 300 then reads the voltage on the charge retentive surface and stores the voltage in the memory 230. The charge-generating emitter ratio determining circuit, routine or application 250 then determines the slope of the second charging unit based on the high and low voltages read by the volt meter 300 and stored in the memory 230. The second charging unit target voltage determining circuit, routine or application 260 determines the second target voltage of the second charging unit.

The final voltage comparing circuit, routine or application 270 determines whether the final actual photoreceptive voltage on the charge retentive surface is within an acceptable range of the target final voltage, and thus whether the setup process is complete. The grid voltage of the second charging device is set to the determined second target voltage by the second charging unit voltage setting device 600. The first and second charging devices are then used to charge the charge retentive surface. The voltage on the charge retentive surface is then read by the electrostatic volt meter 300 and stored in the memory 230. The final voltage comparing circuit, routine or application 270 then determines whether the actual final voltage is within a determined tolerance of the target final voltage. If the actual final voltage is within the determined tolerance of the final target voltage, the setup process is complete. If the actual final voltage is not within a determined tolerance of the final target voltage, the second charging unit target voltage setting device 260 adjusts the second target voltage in determined increments and this process is repeated until the actual final voltage is within the determined tolerance of the target final voltage, or after some predetermined number of increments have been performed. In that case, a fault indication is output by the final voltage comparing circuit, routine or application 270.

It should also be understood that each of the circuits, routines and/or applications shown in FIG. 6 can be implemented as portions of a suitably programmed general purpose computer. Alternatively, each of the circuits, routines and/or applications shown in FIG. 6 can be implemented as physically distinct hardware circuits using a digital signal processor or using discrete logic elements or discrete circuit elements. The particular form each of the circuits, routines and/or applications in FIG. 6 will take is a design choice and will be obvious and predictable to those skilled in the art. It should also be appreciated that the circuits, routines and/or applications shown in FIG. 6 do not need to be of the same design.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A method for setting the grid voltage of a tandem pin charging device, the method comprising:

determining a charge-generating emitter ratio of a first charging unit;

setting a first grid voltage based on the charge-generating emitter ratio of the first charging unit;

determining a charge-generating emitter ratio of a second charging unit;

setting a second grid voltage based on the determined charge-generating emitter ratio of the second charging unit; and comparing a final voltage of a photoreceptor with a final target voltage.

2. The method of claim 1, wherein determining the charge-generating emitter ratio of the first charging unit comprises:

determining a target voltage of a first charging unit grid;

determining a target voltage of a second charging unit grid;

measuring at least one environmental parameter;

setting a voltage of the first charging unit grid to an amount below the target voltage of the first charging unit grid;

setting the second charging unit grid to a minimum amount;

sensing a first photoreceptor voltage;

setting the first charging unit to an amount above the target voltage of the first charging unit;

setting the second charging unit grid to the minimum amount; and sensing a second photoreceptor voltage.

3. The method of claim 2, further comprising charging the first charging unit grid and the second charging unit grid by a pin scorotron device.

4. The method of claim 2, further comprising charging the first charging unit grid and the second charging unit grid by a pin corotron device.

5. The method of claim 2, further comprising determining the target voltage of the first charging to be about five hundred volts.

6. The method of claim 1, wherein determining the charge-generating emitter ratio of the second charging unit comprises:

setting the first charging unit voltage to a setback target voltage;

setting the second charging unit voltage to a first amount below the final target voltage;

sensing a third photoreceptor voltage;

setting the second charging unit voltage to a second amount below the final target voltage;

sensing a forth photoreceptor voltage.

7. The method of claim 1, further comprising adjusting the second charging unit voltage to one of a higher voltage and a lower voltage when the final voltage of the photoreceptor is not within a predetermined range of the target voltage.

8. The method of claim 7, further comprising counting a number of voltage adjustments with a loop counter and indicating a fault when the number of voltage adjustments reaches a predetermined amount.

9. The method of claim 8, further comprising indicating a fault when the loop counter counts ten voltage adjustments.

10. The method of claim 7, further comprising making no adjustment to the second charging unit voltage when the final voltage is within the predetermined range of the target voltage.

11. The method of claim 7, further comprising adjusting the offset voltage in increments of about five volts.

12. The method of claim 7, further comprising determining that the predetermined range is one of about ten volts above the target voltage and about ten volts below the target voltage.

13. The method of claim 1, further comprising determining the final target voltage to be about six hundred and fifty volts.

14. The method of claim 1, further comprising measuring the final voltage of the photoreceptor with an electrostatic volt meter.

15. A charging system control system that controls the grid voltage setup process of a tandem pin charging device, comprising:

a first charging unit target voltage determining circuit, routine or application that determines the target voltage for a first charging unit;

a second charging unit target voltage determining circuit, routine or application that determines the target voltage of a second charging unit;

a charge-generating emitter ratio determining circuit, routine or application that determines the charge-generating emitter ratio of at least one of the first charging unit and the second charging unit; and a final voltage comparing circuit, routine or application that compares a final voltage applied to a photoreceptor with a final target voltage.

16. The charging system control system of claim 15, further comprising an input/output interface for inputting data from at least one of an electronic volt meter and an environmental data source to at least one of a memory, a first charging unit target voltage determining circuit, routine or application, a second charging unit target voltage determining circuit, routine or application, a charge generating emitter determining circuit, routine or application and a final voltage comparing circuit routine or application.

17. The charging system control system of claim 15, further comprising a controller for controlling at least one of the first charging unit voltage setting device and the second charging unit voltage setting device.

18. The charging system control system of claim 17, wherein the input/output interface outputs commands from the controller to at least one of a first charging unit voltage setting device and a second charging unit voltage setting device.

19. The charging system control system of claim 15, further comprising a memory for storing data from at least one of the electronic volt meter and the environmental data source.

20. The charging system control system of claim 19, wherein the memory is a nonvolatile memory.

* * * * *